US009936849B2

(12) United States Patent
Johnson

(10) Patent No.: US 9,936,849 B2
(45) Date of Patent: Apr. 10, 2018

(54) JANITORIAL BUCKET AND WRINGER APPARATUS

(71) Applicant: Louis Paul Podraza, Austin, TX (US)

(72) Inventor: Bobby Ray Johnson, Austin, TX (US)

(73) Assignee: Louis Paul Podraza, Austin, TX (US)

( * ) Notice: Subject to any disclaimer, the term of this patent is extended or adjusted under 35 U.S.C. 154(b) by 679 days.

(21) Appl. No.: 14/148,411

(22) Filed: Jan. 6, 2014

(65) Prior Publication Data

US 2015/0190030 A1 Jul. 9, 2015

(51) Int. Cl.
*A47L 13/59* (2006.01)
*A47L 13/51* (2006.01)

(52) U.S. Cl.
CPC ..... *A47L 13/59* (2013.01); *A47L 13/51* (2013.01)

(58) Field of Classification Search
CPC ..... A47L 13/51; A47L 13/59
See application file for complete search history.

(56) References Cited

U.S. PATENT DOCUMENTS 1,767,840 A * 6/1930 Finnell ..... A47L 13/58 15/264
2,554,937 A * 5/1951 Capstack ..... A47L 13/60 15/262
2,655,681 A * 10/1953 Swanson ..... A47L 13/60 15/262
3,756,451 A * 9/1973 Popeil ..... A47J 47/18 15/264
4,713,859 A * 12/1987 Smith, Jr. ..... A47L 13/58 15/264
4,716,619 A * 1/1988 Young ..... F26B 5/14 15/262
4,798,307 A 1/1989 Evrard
4,815,160 A * 3/1989 Smith, Jr. ..... A47L 13/58 15/264
4,908,904 A * 3/1990 Smith, Jr. ..... A47L 13/58 15/264
5,615,447 A * 4/1997 Hardesty ..... A47L 13/58 15/264
5,974,621 A * 11/1999 Wilen ..... A47L 13/59 15/260
7,437,795 B1 * 10/2008 Bez ..... A47L 13/59 15/260
8,381,351 B2 2/2013 Miller
8,544,141 B1 * 10/2013 Kyde ..... A47J 47/18 15/257.7

(Continued)

*Primary Examiner* — Marc Carlson

(57) ABSTRACT

A portable cleaning assembly for containing a cleaning solution and a mop. The assembly comprises a wheeled bucket with a drain opening and a drain valve. The drain valve comprises a biasing member to force a stopper in a downward direction. The assembly further comprises a pivoting handle and at least one rigid handle on the back and/or front wall of the bucket. The assembly comprises a latch connected to a side wall, wherein the latch retains a wringer handle in a downward position. The assembly also comprises a strainer extending vertically and having an upper opening. The assembly can also comprise a wringer having a channel extending vertically along the front wall thereof. The channel is adapted to retain a mop handle therein in an essentially vertical orientation. The front wall can also comprise at least one flexible member to retain the mop handle within the channel.

17 Claims, 5 Drawing Sheets

(56) References Cited

U.S. PATENT DOCUMENTS

| | | | | |
|---|---|---|---|---|
| 2002/0120997 | A1* | 9/2002 | Alt | A47L 13/59 15/261 |
| 2005/0103955 | A1* | 5/2005 | Billman | A46B 17/02 248/113 |
| 2005/0103995 | A1 | 5/2005 | Billman | |
| 2006/0156503 | A1* | 7/2006 | Papa | A47L 13/58 15/264 |
| 2006/0213021 | A1* | 9/2006 | Ducharme | A47L 13/58 15/260 |
| 2006/0277709 | A1* | 12/2006 | Young | A47L 13/512 15/261 |
| 2011/0100929 | A1* | 5/2011 | Van Landingham, Jr. | A47L 13/51 210/767 |
| 2011/0121530 | A1* | 5/2011 | Young | B62B 3/10 280/47.35 |
| 2013/0333152 | A1* | 12/2013 | Shih | A47L 13/142 15/263 |
| 2014/0041146 | A1* | 2/2014 | Venard | A47L 5/08 15/320 |

* cited by examiner

JANITORIAL BUCKET AND WRINGER APPARATUS

FIELD

Embodiments usable within the scope of the present disclosure relate, generally, to a bucket and wringer assemblies usable during floor cleaning operations and, more specifically, to a janitorial bucket and wringer assemblies having functional and safety features for handling thereof, and for retaining the mop handle and the wringer handle in desired positions.

BACKGROUND

When cleaning commercial buildings, such as offices, retail stores, warehouses, and the like, it is common for the floors of such buildings to be wet mopped regularly by janitorial personnel, or any other user, using commercial mops and roll-around cleaning containers. The use of portable cleaning containers, including bucket like containers in connection with various activities, including mopping floors, is well known in the art. Typical mop buckets have wheels secured at the bottom portion thereof, thereby allowing the container to easily move across various surfaces. Commercial mop buckets generally are made of molded plastic that contain water or cleaning solution for wetting the mop.

While numerous body styles have been proposed for mop buckets, the prior art containers have generally failed to address and solve problems relating to the comfort and ease of the person using them. For example, in order to empty these portable mop buckets, most must be actually lifted by the user and the contents emptied into a sink or other receptacle containing a drain. Since a portable mop bucket is generally very bulky and cumbersome to lift even when it is empty, it is understandable why such a cleaning container, filled with cleaning solution, is extremely difficult to lift and empty. There have been attempts made to design portable mop buckets which assist the user in emptying the mop buckets. For example, some mop buckets include a drain opening and stopper disposed in the side or bottom wall. This feature allows the user to move the mop bucket adjacent a floor drain, and by removing the stopper from the drain opening the mop bucket may be easily emptied. There are disadvantages with this particular design since the user has to physically push the stopper into the drain opening to maintain the stopper therein, while other stoppers may allow fluids to leak through the drain opening. In some cases, the user will be required to insert at least one of their hands into the dirty cleaning solution in order to insert or remove the stopper from the drain opening. Therefore, there is a need for a mop bucket having a plug that extends above the cleaning solution and effectively blocks the flow of cleaning solution through the drain opening.

Another problem with commercial mop buckets is due to clogging of drains when the container solutions are disposed, including insoluble materials such as contaminants, mop strings and the like in the drain. Further, after use it is often difficult to sanitize the container and to remove residual insoluble materials therefrom. Therefore, a need has long been recognized for an improved container for use in the cleaning or mopping of floors which solve these and other problems associated with conveniently and safely disposing of used cleaning solutions.

In addition, such mop buckets usually are provided with a wringer assembly for ringing excess water or cleaning solution from the mop after it has been dipped in the bucket and before it is applied to the floor. Wringer assemblies are available in a variety of forms such as, for example, down press wringers and side press wringers, but all function in substantially the same way by compressing the mopping yarns of the mop between opposed surfaces to squeeze excess absorbed liquid from the mop yarns. As liquid is squeezed from the mop yarns, it is expelled from the wringer through perforations or through other openings in the opposed surfaces of the wringer and falls back down into the bucket.

Wringers are typically mounted on the container during cleaning operations and are operable by a handle to squeeze the mop between a wall of the wringer and a movable plate. For convenience of use, the movable plate is spring biased away from such wall of the wringer, and the wringer comprises a mechanical linkage between the plate and the handle that extends the handle longitudinally of the wringer body at such times that the plate is displaced from such wall so that the handle extends generally vertically from the container upon which the wringer is mounted. A handle that extends vertically presents a potential danger to janitorial personnel and other individuals, who can accidentally contact the handle and trip over it or tip the bucket over, spilling its contents. Furthermore, if a bypasser slips near the bucket, he or she can seriously hurt themselves if they fall on the top of the handle. Therefore, there is a need for a bucket that can retain the handle in a retracted position, thereby improving safety for janitorial personnel and other individuals walking nearby.

Another problem with commercial mop buckets occurs when janitorial personnel need to take a break and leave the mop and mop bucket unattended. Since the mopping yarns are usually wet, the mop cannot conveniently be left on the floor and generally must be left in the mop bucket itself. However, since the handles of commercial mops tend to be relatively heavy, they tend to fall over and, in some cases, their weight can flip the entire mop out of the bucket resulting in a mess that must be cleaned. Accordingly, it has been common that, when a mop is to be left unattended, the bucket and mop are rolled to a wall or other structure and the mop handle is leaned against the wall to support it and prevent it from flopping over. This solution is a less than desirable, particularly in large open buildings such as warehouses, since the mop and mop bucket must be moved away from the area being mopped and returned when it is desired to continue the mopping operation. This is inconvenient and can add a surprising amount of unproductive time in simple relocation of the mop bucket during a large mopping operation. Thus, there is a need for a method and apparatus that will eliminate problems caused by mop handles falling over and flipping the mop out of its mop bucket when the mop is unattended. Such a method and apparatus should provide support for the mop handle without requiring that the mop bucket be moved from the area being mopped.

In order to accomplish these goals, those skilled in the art are constantly in search of improved means for filling above listed needs. The disadvantages of the prior art are overcome by the present invention.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Before describing selected embodiments of the present invention in detail, it is to be understood that the present invention is not limited to the particular embodiments described herein. The disclosure and description of the invention is illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention.

As well, the drawings are intended to describe the concepts of the invention so that the presently preferred embodiments of the invention will be plainly disclosed to one of skill in the art, but are not intended to be manufacturing level drawings or renditions of final products and may include simplified conceptual views as desired for easier and quicker understanding or explanation of the invention. As well, the relative size and arrangement of the components may differ from that shown and still operate within the spirit of the invention as described throughout the present application.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Figure 1:
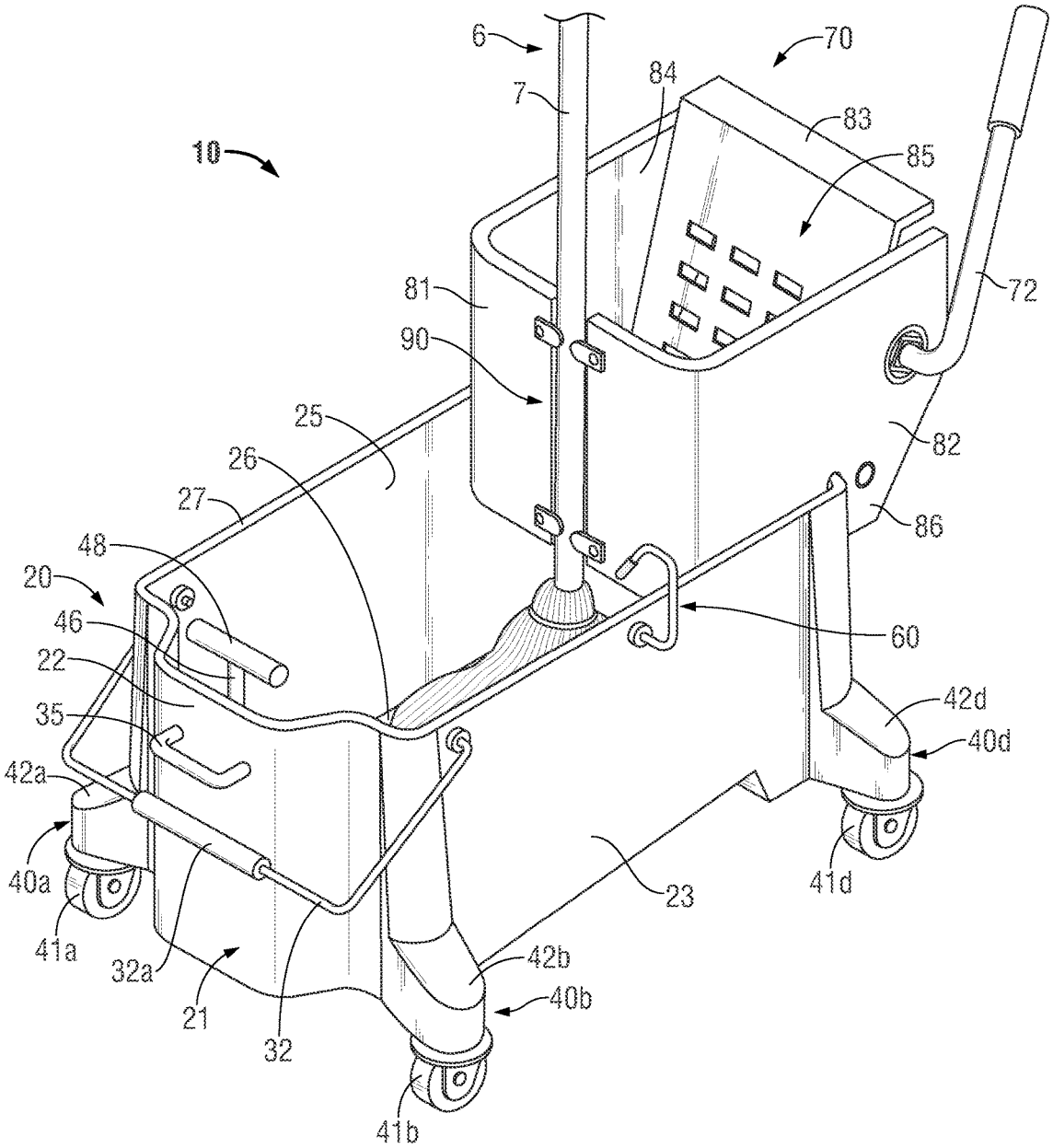
FIG. 1 depicts an isometric view of an embodiment of a bucket and wringer assembly usable within the scope of the present disclosure.

Referring now to the drawings, and particularly to FIG. 1, shown therein is a portable cleaning station (10), comprising a bucket assembly (20) and a wringer (70) supported on one end of a body portion (21) of the bucket assembly (20).

Figure 2:
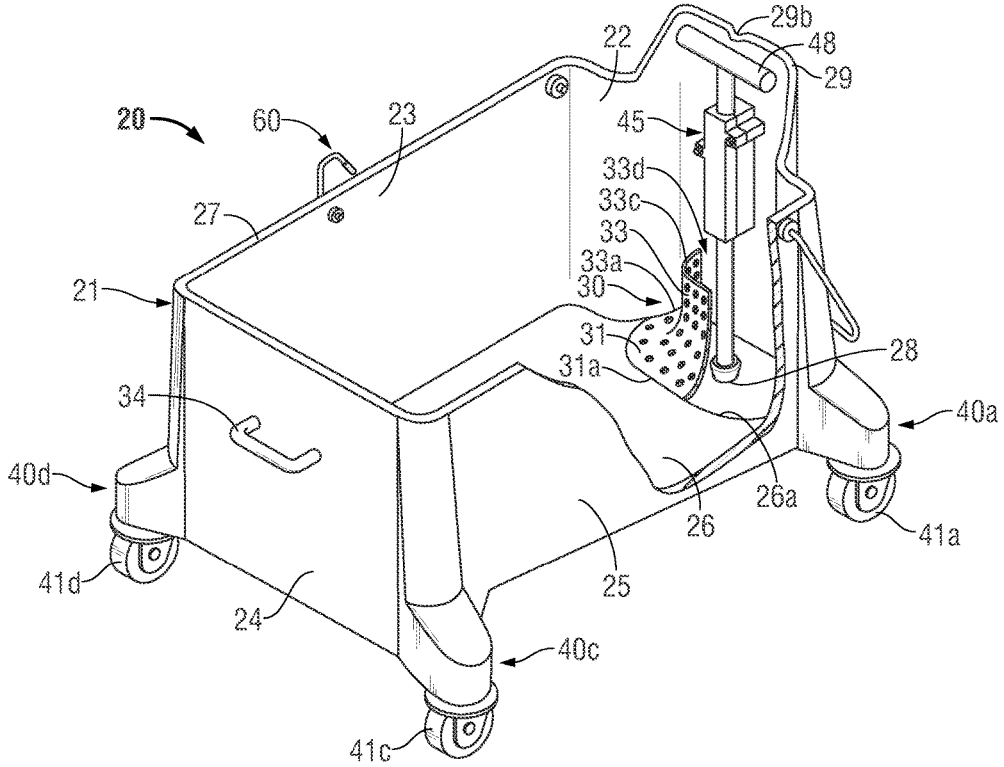
FIG. 2 depicts an isometric view of an embodiment of the bucket assembly usable within the scope of the present disclosure.
Figure 3:
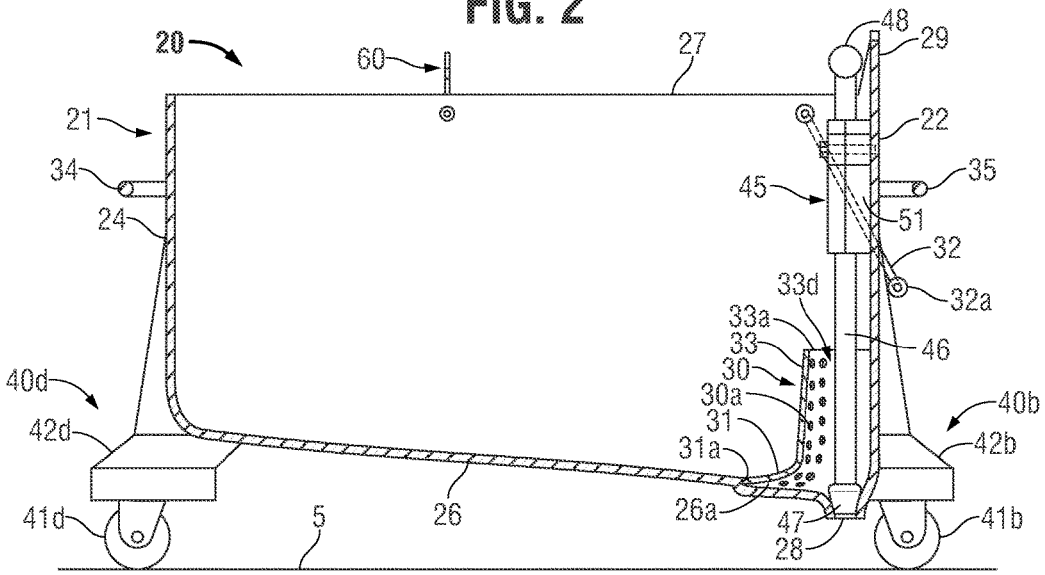
FIG. 3 depicts a side cross-sectional side view of an embodiment of the bucket assembly usable within the scope of the present disclosure.

Referring also to FIGS. 2 and 3, showing an isometric and a side cross sectional views of an embodiment of a bucket assembly (20) in accordance with the present disclosure. The depicted bucket assembly (20) comprises a body portion (21) having a front wall (22), spatially disposed side walls (23, 25), a back wall (24), and a bottom portion (26). As shown in the Figures, the side walls (23, 25), the front wall (22), and the back wall (24), are generally vertical with respect to the ground or floor (5), while the bottom portion (26) is inclined or sloped downwardly. In order to insure proper drainage of the cleaning solution from the body portion (21), the bottom portion (26) slopes downwardly towards the drain opening (28) (e.g., towards the front wall (22)). In other embodiments (not shown) of the cleaning station (10), the walls (22-25) of the body portion (21) can be inwardly declined (e.g., inwardly sloped) in the direction of the bottom portion (26), whereby the cross-sectional configuration of the body portion (21) can form a trapezoid.

As further depicted in FIGS. 2 and 3, the bucket assembly (20) comprises a strainer (30) positioned around the drain opening (28) to prevent large pieces of refuse or mop fibers from flowing into and clogging the drain opening (28). The strainer (30) is depicted comprising a lower portion (31) having a generally horizontal and/or sloping semicircular surface with an outer edge (31*a*), which mates with the periphery of a strainer recess (26*a*) formed in the bottom portion (26). When the lower portion (31) of the strainer (30) mates with or is positioned within the strainer recess (26*a*), the strainer (30) is retained therein, whereby the cleaning fluid can pass through a plurality of holes (30*a*) and out of the body portion (20) of the bucket assembly (20) through the drain opening (28).

The strainer is further depicted comprising an upper portion (33) having a semi-tubular configuration centered on and extending upwardly from the lower portion (31). As illustrated in FIG. 2, the upper portion is configured to extend arcuately about the drive rod (46) and the stomper (47). The upper portion further comprises side edges (33*a*, 33*b*, 33*b* not shown) that can abut the inside surface of the front wall (22) to create a seal sufficient to prevent large pieces of refuse or mop fibers from flowing therethrough and into the drain opening (28). The upper portion (33) comprises an upper edge (33*c*), which defines an opening (33*d*) in the upward direction. In the depicted embodiment, the opening (33*d*) is sufficiently large to allow janitorial personnel to insert their hand or an external tool (not shown) to clean out any large pieces of refuse or mop fibers, which may be clogging the drain opening (28).

Although FIGS. 2 and 3 depict a strainer (30) that is attachable to the body portion (21) of the bucket assembly (20) and, therefore, removable from the bucket assembly (20), in an alternate embodiment (not shown) of the cleaning station (10), the strainer can be permanently connected to the body portion (21). Specifically, the outer edge (31*a*) and the side edges (33*a*, 33*b*) of the strainer (30) can be integrally formed, molded, or otherwise permanently connected with the body portion (21) of the bucket assembly (20).

FIGS. 2 and 3 further depict a plurality of holes (30*a*) formed through the lower portion (31) and the upper portion (33) to permit passage of the cleaning solution through the strainer (30) while large pieces of refuse or mop fibers can be retained on the surface thereof. Although circular holes (30*a*) are depicted, in alternate embodiments (not shown) of the cleaning station (10), the strainer (28) can comprise elongated holes, slits, or perforations having any other shape.

Referring now to FIGS. 1 and 3, each leg (40*a-d*) of the bucket assembly (20) is depicted extending outwardly from each corner of the body portion (21). The positioning of the legs (40*a-d*, 40*c* shown in FIG. 2), relative to the body portion (21), improves the stability of the body portion (21) as the cleaning station (10) is moved along the floor (5) or supporting surface via wheels (41*a-d*, 41*c* shown in FIG. 2) or castor assemblies, connected to a distal end portion of each of the legs (40*a-d*). The wheels (41*a-d*) can be connected to the legs (40*a-d*) of the bucket assembly (20), by any means known in the art. For example, a shank (not shown), extending from each wheel (41*a-d*) assembly, can be positioned through an aperture (not shown) in the distal end portion of each of the legs (40*a-d*) for securing each wheel (41*a-d*) to its respective leg (40*a-d*) by way of friction (i.e., interference fit) between the shank and the aperture. When attached to the legs (40*a-d*), the wheels (41*a-c*) are freely rotatable and pivotable to permit selectively directional movement of the cleaning station (10) along the floor (5) or supporting surface. The wheels (41*a-d*) of the bucket assembly (20) can be of any design or construction known in the art and should not be limited to the wheels (41*a-d*) depicted or described in the present application.

To reinforce the legs (40*a-d*) of the bucket assembly (20) and to strengthen their load capacity, each leg (40*a-d*) is shown comprising a support shell portion (42*a-d*, 42*c* not shown) extending between the body portion (21) and each wheel (41*a-d*). The support shells (42*a-d*) provide the legs (40*a-d*) with structural strength to support the body portion (21) above the floor (5) when the body portion (21) is filled with a cleaning solution (not shown), which adds significant weight to the cleaning station (10), resulting in significant compression and torque forces being applied to the legs (40*a-d*).

It should be noted that the body portion (21) and the legs (40*a-d*) can be fabricated of a polymeric material and comprise a unitary construction. However, it should also be understood that in other embodiments (not shown) of the cleaning station (10), the components described above can readily be fabricated as individual components for mutual connection, without departing from the scope of the present disclosure.

Referring again to FIG. 1, a rotatable handle (32) is shown connected to the side walls (23, 25) of the body portion (21), adjacent to the front wall (22) and just below the rim (27). The rotatable handle (32) is illustrated as a substantially U-shaped member having opposite ends pivotally connected to the body portion (21) and a medial portion having a hand grip (32*a*) positioned thereon. Thus, the rotatable handle (32) is selectively movable between a first position and a second position, wherein in the first position, the rotatable handle (32) is disposed in the downward resting position against the body portion (21), substantially as shown. In the second position (not shown) the rotatable handle (32) can be rotated upwards, above the body portion (21) of the bucket assembly (20), so that a person can grasp the hand grip (32*a*) for pulling the cleaning station (10) along the floor (5). In the depicted embodiment of the cleaning station (10), the rotatable handle (32) has sufficient length, between the hand grip (32*a*) and the ends thereof, to allow janitorial personnel to pull the cleaning station (10) without the need to significantly bend or lean over. Any suitable means can be employed for pivotally connecting the opposite ends of the rotatable handle (32) to the body portion (21) of the bucket assembly (20), which permits the desired movement of the rotatable handle (32) between the before-mentioned first and second positions. In an alternate method, the rotatable handle (32) can be used to lift the front portion of the bucket assembly (20) over impediments, barriers, or other protrusions (not shown) along the floor (5), thereby allowing the janitorial personnel to move the cleaning station (10) over such impediments. Although FIGS. 1-3 depict the rotatable handle (32) as rigid U-shaped members pivotally connected to the body portion (21), it should be understood that other handles known in the art, including handles manufactured from a flexible material, are usable within the scope of the present disclosure.

FIGS. 1-3 further depict front and back fixed handles (35, 34) connected to the front and the back walls (22, 24) of the bucket assembly (20), wherein the front and back handles (35, 34) are usable to lift the bucket assembly (20). The back handle (34) can be used to lift the back portion of the bucket assembly (20), thereby allowing the cleaning solution to be poured out over the rim (27) of the front wall (22) of the body portion (21), if one chooses, rather than draining the cleaning solution from the body portion (21) via the drain opening (28). In an alternate method, the bucket assembly (20) can be lifted upwards, with the cleaning solution within the body portion (21), by grasping both the front and back handles (35, 34), thereby allowing janitorial personnel to pour the cleaning solution into a sink, toilet bowl, or other raised disposal locations. To lift the bucket assembly (20), janitorial personnel can grasp the back handle (34) with one hand and grasp the front handle (35) with the other hand, and pull the bucket assembly (20) off the ground (5), thereby lifting the bucket assembly (20) to a desired height. Although FIGS. 1-3 depict the front and back handles (35, 34) as U-shaped members fixedly connected to the front and back walls (22, 24), it should be understood that any handle known in the art is usable within the scope of the present disclosure.

Referring again to FIGS. 2 and 3, depicting an embodiment of the cleaning station (10) in accordance with the present disclosure. As illustrated, the bucket assembly (20) generally comprises a body portion (21) for containing a cleaning solution, a drain opening (28) extending through lowermost point of the bottom portion (26), and a valve assembly (45) for closing the drain opening (28) during use of the cleaning station (10), wherein the valve assembly is shown mounted on the inward surface of the front wall (22).

Figure 4:
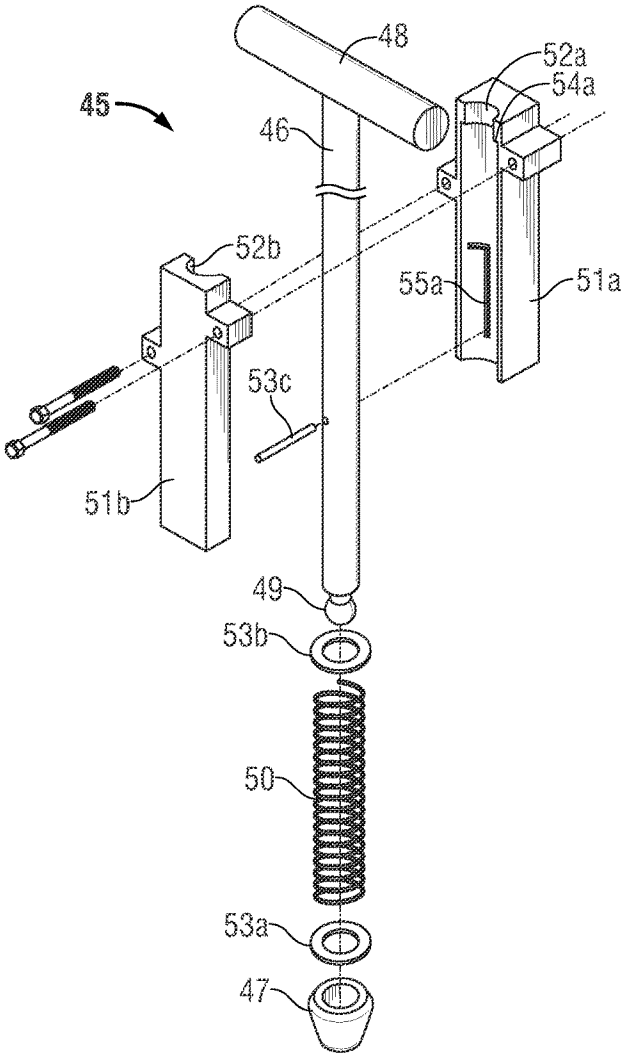
FIG. 4 depicts an exploded view of an embodiment of a plug valve usable within the scope of the present disclosure.

Referring also to FIG. 4, depicting an exploded view of an embodiment of the valve assembly (45) usable in accordance with the present disclosure. The valve assembly (45) can comprise valve body (51) having two portions (51*a*, 51*b*), having semicircular channels (52*a*, 52*b*) extending vertically along the inward side surfaces. The body portions (51*a*, 51*b*) can be held together about a drive rod (46) and in connection with the front wall (22) of the body portion (21) by connectors, for example, a set of bolts. The valve body portions (51*a*, 51*b*) can be secured together and/or to the front wall (22) of the bucket body portion (21) by any other suitable means, provided that the means allow the drive rod (46) movement within the valve body (51) and fixedly secure the valve body (51) to the front wall (22). The drive rod (46) is depicted in FIGS. 3 and 4 as an elongated and generally round shaft, extending vertically along the inward surface of the front wall (22) between. The Figures further depict the upper end of the drive rod (46) comprising a valve handle (48) positioned above the rim (27), wherein the valve handle (48) permits the drive rod (46) to be easily grasped and pulled between an upper and lower position. The valve handle (48) also allows the drive rod (46) to be easily rotated to lock the drive rod (46) in the upper or the lower position. The lower end of the drive rod (46) is shown comprising a stopper (47) positioned above the drain opening (28), wherein the stopper can be attached to the drive rod by a mount ball (49), which can be inserted into an opening formed in the stopper (47). The depicted stopper (47) can comprise an elastomeric material and be adapted to cover the drain opening (28), or at least partially enter the drain opening (28) to block the escape of cleaning solution from within the bucket assembly (20).

Referring still to FIGS. 3 and 4 depicting an exploded view of an embodiment of the valve assembly (45) comprising a drive rod (46), which can be selectively moved between an upper position and a lower position. In the lower position, the stopper (47) is placed about or at least partially within the drain opening (28), to block the flow of cleaning solution through the drain opening (28), while in the upper position the stopper (47) is positioned above the drain opening (28), thereby allowing cleaning solution to flow through the drain opening (28) out of the bucket body (21). As further depicted in FIG. 4, the valve assembly (45) comprises an internal spring (50) positioned about the drive rod (46). The upper end of the spring (50) can abut the upper shoulders (54*a*, 54*b*, 54*b* not shown) of the semicircular channels (52*a*, 52*b*) in the valve body portions (51*a*, 51*b*). An upper washer (53*b*) can be included between the spring (50) and the upper shoulders (54*a*, 54*b*). The lower end of the spring (50) can abut a lower washer (53*a*) positioned about the drive rod (46), wherein the lower washer (53*a*) can be retained in position by a retainer pin (53*c*) extending laterally through the drive rod (46). The spring can be compressed between the upper and lower washers (53*b*, 53*a*), thereby biasing the drive rod (46) in the downward direction, forcing the stopper (47) into the drain opening (28) to block the flow of cleaning solution out of the body portion (21) of the bucket assembly (20).

In order to maintain the stopper (47) in the upward (i.e., open) position, against the biasing force of the spring (50), FIGS. 2 and 3 further depict a pedestal (29) adapted to support the valve handle (48). In operation, janitorial personnel (not shown) can pull the valve handle (48) upward above the pedestal (29), rotate the valve handle (48) about 90 degrees, and position the handle (48) on top of the pedestal (29). The pedestal (29) can have a notch or a recess (29*a*) thereon to maintain the handle (48) in position thereon. Although the pedestal shown in FIGS. 2 and 3 is depicted as a plate integrally connected to and vertically extending from the front wall (22), in other embodiments (not shown), the pedestal can be adapted for connection to and disconnection from the front wall (22) and/or comprise a different configuration usable to support the handle (48) in the upward position.

As further depicted in FIG. 4, the valve assembly (45) can be adapted to retain the drive rod (46) in an upward position by other means. Instead of or in addition of having the pedestal (29), each semicircular channel (52*a*, 52*b*) of the valve body portions (51*a*, 51*b*) can have an L-slot (55*a*, 55*b*, 55*b* not shown) extending along the surface thereof. The L-slots (55*a*, 55*b*) are adapted to receive the retainer pin (53*c*) extending through the drive rod (46). During operations, the retainer pin (53*c*) can be positioned within the longitudinal portion (i.e., vertical) of the L-slots (55*a*, 55*b*), thereby allowing the drive rod (46) vertical movement between upward (i.e., open) and downward (i.e., closed) positions. When the drive rod (46) is pulled by the valve handle (48) and moved to the upward position, the drive rod (46) can be locked in the upward position by rotating the valve handle (48) to position the retainer pin (53*c*) within the lateral (i.e., horizontal) portion of the L-slots (55*a* 55*b*).

Although FIGS. 2, 3, and 4 depict an embodiment of the cleaning station (10) comprising a specific valve assembly (45), it should be understood that valve assemblies comprising different structure and means for biasing a stopper towards the downward position can be included and are within the scope of the present disclosure.

Figure 5:
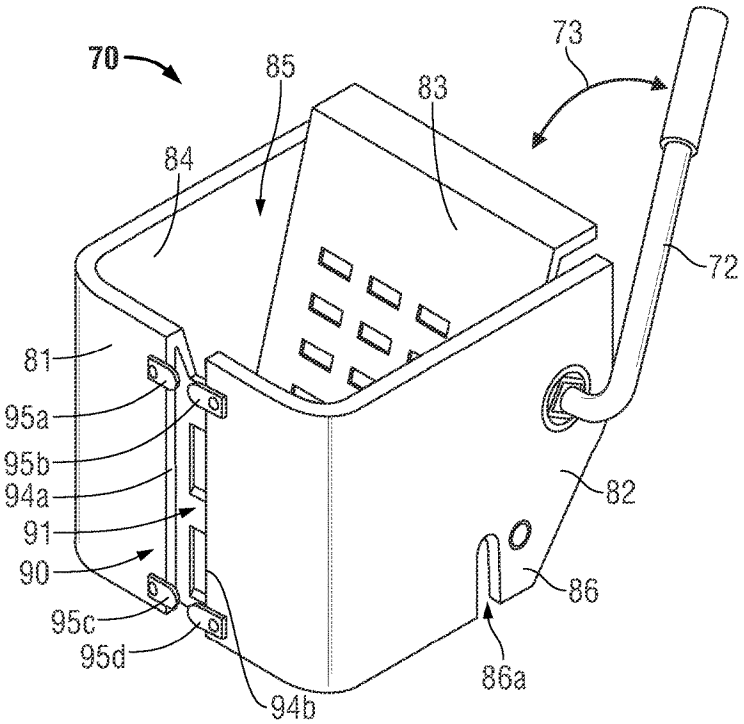
FIG. 5 depicts an isometric view of an embodiment of the wringer assembly usable within the scope of the present disclosure.

Referring now to FIG. 5, depicting an isometric view of an embodiment of a wringer assembly (70) in accordance with the present disclosure. FIG. 5 illustrates a side press wringer type that embodies principles of the present disclosure. It should be understood that other types of wringer assemblies, such as down press type and a roller type, are usable within the scope of the present disclosure. As the wringer assembly depicted in FIG. 5 has been presented only as an embodiment to illustrate portions of the present invention, the present disclosure should not be limited to use with a side press wringer assembly.

The wringer assembly (70) can be manufactured of rigid molded plastic, but that can be fabricated from any appropriately rigid material such as metal or acrylic. FIG. 5 depicts the wringer assembly (70) having a front wall (81), a first side wall (82), and a second side wall (84). A pair of spaced downward projections (86, 88, 88 not shown) are formed at the back of the wringer assembly (70) on either side thereof, wherein the projections (86, 88) define recesses (86*a*, 88*a*, 88*a* not shown) sized to be placed over the top ridge (27) of the back wall (24) of the bucket body (21), as depicted in FIG. 1.

Referring to FIG. 5, the front wall (81) of the wringer assembly (70) can be formed with an array of openings through which liquid can pass. A wringer plate (83) is depicted positioned opposite the front wall (81). The front wall (81), the side walls (82, 84), and the wringer plate (83) define an inner upwardly open well (85) sized to receive the mopping yarns of a mop (6, see FIG. 1) for wringing excess liquid from the mop. The wringer plate (83) is movable toward and away from the front wall (81) by movement of an associated wringer handle (72) in the direction of arrow (73). When the wringer handle (72) is pressed forwardly and downwardly, the wringer plate (83) moves toward the front wall (81) of the wringer assembly (70). In use, the yarns of a mop (6) are dipped into liquid cleaning agent within the bucket body (21), placed in the well (85) of the wringer assembly (70), and excess fluid is squeezed out by pressing down on the wringer handle (72), which compresses the mopping yarns between the wringer plate (83) and the front wall (81).

The wringer assembly (70), depicted in FIGS. 1 and 5, further comprises a mop support assembly (90) adapted for receiving and supporting the handle (7) portion of the mop (6). A close-up view of the mop support assembly (90) is shown in FIG. 5, wherein the Figure depicts the mop support assembly (90) comprising a cavity or a channel (91) extending generally vertically along the front wall (81). The channel (91) can be integrally formed within the front wall (81), wherein the channel is defined by side surfaces (94*a*, 94*b*) along the front wall (81). The support assembly (90) is further shown comprising mop retainers, adapted to maintain the mop (6) within the channel (91). The mop retainers are depicted in FIG. 5 as two sets of rubber fingers (95*a-d*), positioned on each side of the channel (91) and extending toward each other. The distance between the rubber fingers (95*a-d*), on each side of the channel (91) can be smaller than the diameter of the mop handle (7), thereby retaining the handle (7) within the channel (91). The rubber fingers (95*a-d*) can allow a mop handle (7) to be inserted into the channel (91) by pushing or forcing the mop handle (7) therein, through or between the fingers (95*a-d*). The mop handle can be withdrawn by pulling or forcing it out of the channel (91) through or between the rubber fingers (95*a-d*). Although the fingers (95*a-d*) are described as comprising rubber and are depicted being retained in position by screws or bolts, in alternate embodiments the fingers can comprise any flexible material and can be connected to the front wall by any means known in the art. Although the mop retainers are depicted in FIG. 5 as rubber fingers (95*a-d*), any flexible or movable projections or members can be used to retain the mop within the channel (91), and are within the scope of the present disclosure.

Figure 6A:
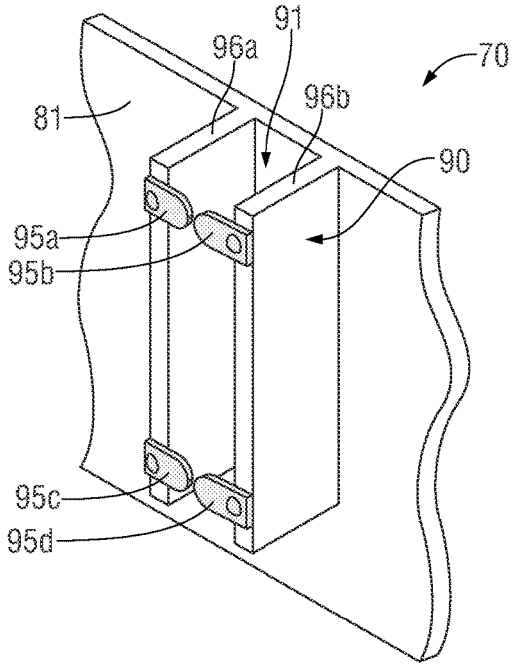
FIG. 6A depicts a close-up view of an embodiment of the wringer assembly usable within the scope of the present disclosure.
Figure 6B:
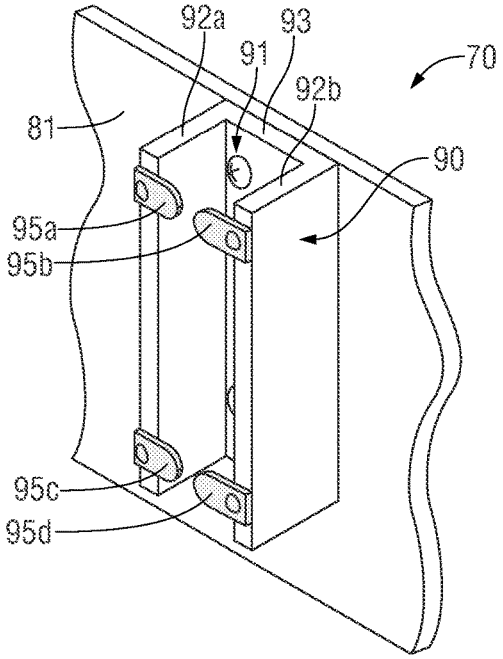
FIG. 6B depicts a close-up view of an embodiment of the wringer assembly usable within the scope of the present disclosure.
Figure 6C:
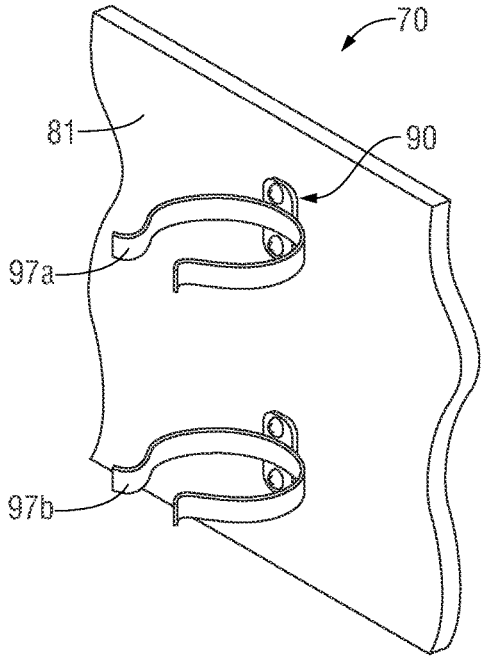
FIG. 6C depicts a close-up view of an embodiment of the wringer assembly usable within the scope of the present disclosure.

Referring now to FIGS. 6A-6C, showing close-up views of alternate embodiments of the wringer assembly (70). Specifically, FIG. 6A shows a mop support assembly (70) having the channel (91) formed between two or more lips (96*a*, 96*b*) (e.g., elongated protrusions, rectangular bars) extending generally vertically and in parallel relative to each other along the surface of the front wall (81). In the embodiment, the lips (96*a*, 96*b*) can be integrally formed on the surface of the front wall (81) to define the channel (91). Similarly to the previously described embodiment of the wringer assembly (70), the lips (96*a*, 96*b*) can support various mop retainers, including, but not limited to, the rubber fingers (95*a*, 95*b*), to retain the mop handle (7) within the channel (91).

In another embodiment of the wringer assembly (70), depicted in FIG. 6B, the lips (92*a*, 92*b*) (e.g., elongated protrusions, rectangular bars) can be provided as separate elements, which are adapted for attachment to the front wall (81) of a conventional wringer assembly. The depicted embodiment of the supporting assembly (90) comprises a U-shaped rail (93) having two essentially parallel lips (92*a*, 92*b*) forming the channel (91) therebetween, wherein the rail (93) can be affixed to the front wall (81) by any known means, including bolts. Also, similarly to the embodiments depicted in FIGS. 5 and 6A, the lips (92*a*, 92*b*) of the wringer assembly (70), can comprise various mop retainers, including the rubber fingers (95*a*, 95*b*), to retain the mop within the channel (91).

In yet another embodiment of the wringer assembly (70), depicted in FIG. 6C, the mop retainer omits the lips (92*a*, 92*b*, 96*a*, 96*b*) described above. FIG. 6C depicts two mop retainers, which can include upper and lower clips (97*a*, 97*b*), adapted to receive a mop handle (7) and hold it in vertical position as depicted in FIG. 1. The depicted clips (97*a*, 97*b*) or other mop retainers (not shown), such as snap-fit clips, brackets, or flexible projections, can be used to engage the mop handle (7) in a frictional manner, thereby securing the mop handle (7) therein. The clips (97*a*, 97*b*) are depicted having a curved contoured back surface and are forwardly open for receiving the mop handle (7). The diverging ends of the clips (97*a*, 97*b*) can direct the mop handle into the interior of the clips (97*a*, 97*b*). During use, the upper and lower clips (97*a*, 97*b*) can receive a mop handle (7) by pushing the handle (7) into the interior of the clips (97*a*, 97*b*), wherein the mop handle (7) can be withdrawn from the interior of the clips (97*a*, 97*b*) by pulling the handle (7) in a lateral direction out of the clips (97*a*, 97*b*).

The various embodiments of the wringer assembly described above can be used to support the mop handle (7) when the cleaning station is unattended and/or not used. Specifically, when janitorial personnel desire to take a break or otherwise leave a mop (6) unattended within the bucket assembly (20), the handle (7) can be retained in the upright orientation by the supporting assembly (90) of the wringer assembly (70) and the mopping yarns of the lower end of the mop (6) can remain in the interior of the body portion (21) until it is desired to continue the mopping operations.

Figure 7A:
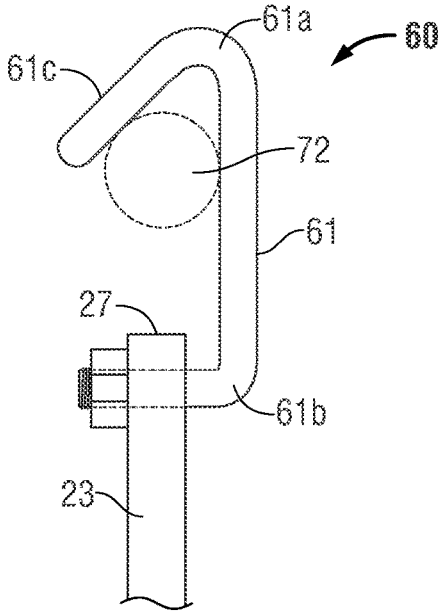
FIG. 7A depicts a close-up view of an embodiment of the wringer handle retainer usable within the scope of the present disclosure.
Figure 7B:
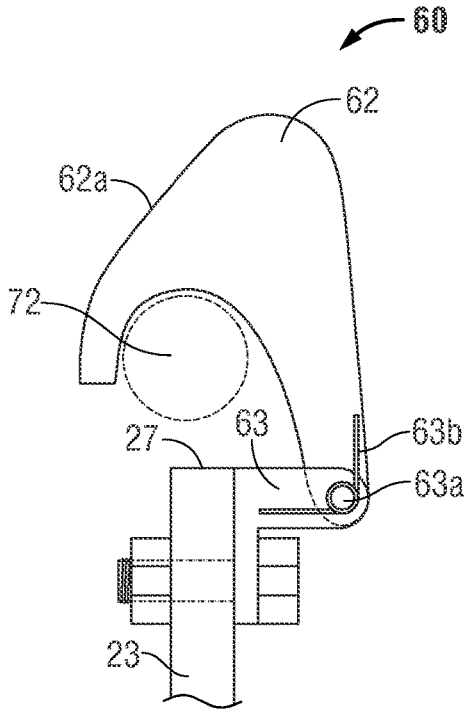
FIG. 7B depicts a close-up view of an embodiment of the wringer handle retainer usable within the scope of the present disclosure.
Figure 7C:
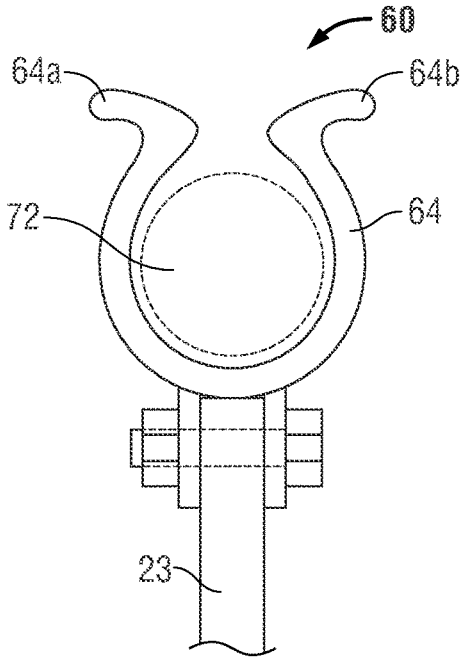
FIG. 7C depicts a close-up view of an embodiment of the wringer handle retainer usable within the scope of the present disclosure.

Referring again to FIG. 1 and also to FIGS. 7A-7C, the bucket assembly (20) is further depicted comprising a wringer handle retainer (60) adapted to receive and hold the wringer handle (72) in a downward position. FIG. 1 shows the handle retainer (60) connected to the upper portion of the side wall (23) adjacent to the rim (27) of the body portion (21) of the bucket assembly (20). FIGS. 7A-7C, showing close-up views of two embodiments of the handle retainer (60) in accordance with the present disclosure. FIG. 7A depicts the handle retainer (60) comprising an elongated flexible body (61) having a hook portion (61*a*) adapted to latch about the wringer handle (72) and hold it adjacent to the rim (27) of the side wall (23). The elongated body (61) can be constructed from any material having adequate flexibility to bend as the wringer handle (72) is pressed against the downwardly sloping portion (61*c*) of the hook portion (61*a*). The elongated body (61) can comprise adequate strength to latch the wringer handle (72) with the upper hook portion (61*a*) and retain the wringer handle (72) in the downward position. Specifically, the elongated body (61) can be fabricated using various metals or plastics comprising the abovementioned properties. The lateral portion (61*b*) of the flexible body (61) is shown extending through the side wall (23) to retain the flexible body (61) in position. Although a retaining nut is depicted retaining the flexible body (61) in connection within the side wall (23), any means known in the art can be employed to retain the handle retainer (60) in connection with the side wall (23).

FIG. 7B depicting another embodiment of the handle retainer (60). The Figure depicts a handle retainer (60) comprising a hook member (62) adapted to latch against the wringer handle (72) and hold it adjacent to the rim (27) of the side wall (23). An L-shaped bracket (63) is shown connecting the hook member (62) to the side wall (23) by means of a bolt. The hook member (62) and the bracket (63) are pivotally connected by a pin (63*a*) extending through the bottom portion of the hook member (62). The pin (63*a*) can comprise a torsion spring (63*b*) positioned thereabout, wherein the torsion spring (63*b*) can bias the hook member (62) towards the depicted (i.e., vertical) position. Although a bolt is depicted retaining the bracket (63) in connection within the side wall (23), any means known in the art can be employed to retain the handle retainer (60) in connection with the side wall (23).

FIG. 7C depicts yet another embodiment of the handle retainer (60). The Figure depicts a handle retainer (60) comprising a clip (64) adapted to latch the wringer handle (72) and hold it adjacent to the rim (27) of the side wall (23). The depicted clip (64) is a snap-fit clip usable to engage the wringer handle (72) in a frictional manner, thereby securing the wringer handle (72) therein. The clip (64) is depicted having a generally round body and being forwardly open for receiving the wringer handle (72). The diverging ends (64*a*, 64*b*) can direct the wringer handle (72) into the interior of the clip (64). During use, the clip (64) can receive a wringer handle (72) by pushing the wringer handle (72) into the interior of the clip (64), wherein the wringer handle (72) can be withdrawn from the interior of the clip (64) by pulling the wringer handle (72) in the upward direction out of the clip (64).

Between cleaning operations, when the wringer handle (72) is desired to be retained in the downward position, janitorial personnel can manually move the wringer handle (72) against the sloped surfaces (61*c*, 62*a*) of the hook portions (61*a*, 62). As the wringer handle (72) is moved further downward against the sloped surfaces (61*c*, 62*a*), the hook portions (61*a*, 62) move in the lateral direction with respect to the wringer handle (72). This allows the wringer handle (72) to move below the hook portions (61*a*, 62), which then extend over the wringer handle (72), latching them in the lower position. To release the wringer handle (72) and move it to its upper position, the handle (72) can be manually pulled up to release it from the hook member (61*a*) in FIG. 7*a*. To release the wringer handle (72) from the handle retainer 60 depicted in FIG. 7B, janitorial personnel can manually rotate the hook member (62), thereby releasing the wringer handle (72).

While various embodiments of the present invention have been described with emphasis, it should be understood that within the scope of the appended claims, the present invention might be practiced other than as specifically described herein.

What is claimed is:

1. A portable cleaning assembly for containing a cleaning solution and a mop, the assembly comprising:

a bucket body for containing a cleaning solution, wherein the bucket body has a front wall at a front end of the bucket body, a back wall at a back end of the bucket body, a first side wall, a second side wall, and a bottom section, wherein the bottom section comprises a drain hole, wherein the front wall comprises a pedestal;

wheels attached on opposite sides of the bucket body adjacent to the bottom section, thereby allowing the portable cleaning assembly to roll along a surface; and a plug valve connected to the front wall, wherein the plug valve comprises a generally vertical shaft and a biasing spring, the vertical shaft comprising a valve handle on the upper end thereof and a drain plug on the lower end thereof, wherein the valve handle is movable and rotatable between a lower position and an upper position, wherein the upper position rests the valve handle on the pedestal of the front wall at a height sufficient to clear the drain plug from the drain hole, wherein the lower position rests the drain plug in the drain hole, and wherein the plug valve is biased towards the lower position by the spring.

2. The assembly of claim 1, further comprising a curved handle pivotally connected to the bucket body adjacent to the front wall, wherein the curved handle is adapted for lifting the front end of the bucket body.

3. The assembly of claim 1, further comprising a back handle fixedly connected to the back wall.

4. The assembly of claim 3, further comprising a front handle fixedly connected to the front wall.

5. The assembly of claim 1, further comprising a latch connected to the first side wall, the second side wall, or combinations thereof, wherein the latch extends above an upper edge of the first side wall or the second side wall, wherein the latch is adapted to receive and hold a wringer handle in a downward position.

6. The assembly of claim 5, wherein the latch is movable by the wringer handle when the wringer handle is pressed against the upper portion of the latch.

7. The assembly of claim 1, further comprising a strainer positioned about the drain hole, wherein the strainer comprises a side surface extending in a generally vertical direction, wherein the side surface comprises an upper edge defining an open space, and wherein the open space is adapted to allow a hand to be inserted therethrough.

8. The assembly of claim 7, wherein the upper edge of the side surface is located below an upper edge of the front wall.

9. The assembly of claim 1, further comprising a wringer, wherein the wringer has a channel extending vertically along the front wall thereof, wherein the channel is adapted to retain a mop handle therein in an essentially vertical orientation.

10. A wringer assembly adapted for attachment to a bucket for wringing excess cleaning solution from a mop, wherein the wringer assembly comprises:

a front wall;

a first side wall;

a second side wall;

a wringer plate movable toward and away from the front wall for squeezing the mop therebetween;

a first support assembly integrally or mechanically attached to the front wall; and a second support assembly integrally or mechanically attached to the front wall, wherein the second support assembly is vertically aligned with the first support assembly such that the support assemblies are spaced along a longitudinal axis, and wherein the first support assembly and the second support assembly retain a mop handle adjacent to the front wall in an upward position along the longitudinal axis.

11. The wringer assembly of claim 10, further comprising an elongated channel extending upwardly along the longitudinal axis and within the front wall, wherein the first support assembly comprises at least one protrusion or flexible member extending about the elongated channel, wherein the second support assembly comprises at least one protrusion or flexible member extending about the elongated channel, and wherein the respective at least one protrusion or flexible member of the first support assembly and the at least one protrusion or flexible member of the second support assembly retain the mop handle within the elongated channel in the upward position.

12. The wringer assembly of claim 10, further comprising an elongated channel extending upwardly along the longitudinal axis and within the front wall, wherein the first support assembly comprises at least two flexible members connected on opposite sides of the longitudinal axis and extending towards each other, wherein the second support assembly comprises at least two flexible members connected on opposites sides of the longitudinal axis and extended towards each other, and wherein the at least two flexible members of the first support assembly and the at least two flexible members of the second support assembly retain the mop handle within the elongated channel in the upward position.

13. The wringer assembly of claim 10, further comprising an elongated channel extending upwardly along the longitudinal axis and within the front wall, wherein the first support assembly comprises at least two protrusions extending towards each other, wherein the at least two protrusions are connected on opposite sides of the elongated channel, wherein the at least two protrusions retain the mop handle within the elongated channel in the upward position.

14. The wringer assembly of claim 10, further comprising:

at least two bars projecting laterally from the front wall and extending upwardly in a generally parallel configuration along the front wall, wherein the at least two bars are adapted to receive the mop handle therebetween;

the first support assembly further comprising a first protrusion or flexible member extending from a bar of the at least two bars; and the second support assembly further comprising a second protrusion or flexible member extending from a bar of the at least two bars, wherein the first and second protrusions or flexible members are adapted to retain the mop handle in the upward position between the at least two bars.

15. A portable bucket assembly for containing a cleaning fluid, the assembly comprising:

a bucket body for containing a cleaning solution, wherein the bucket body comprises:

a front wall at a front end of the bucket body, the front wall comprising a pedestal;

a back wall at a back end of the bucket body;

a first side wall;

a second side wall; and a bottom section, wherein the bottom section comprises a drain hole;

wheels attached on four sides of the bucket body, thereby allowing the bucket body to roll along a surface;

a valve assembly connected along an interior side of the front wall, wherein the valve assembly comprises a shaft, wherein the shaft has a valve handle on the upper end thereof, wherein the shaft has a stopper on the lower end thereof, wherein the valve assembly further comprises a spring that biases the shaft in a lower position wherein the stopper occupies the drain hole, and wherein the valve handle is liftable and rotatable from the lower position to an upper position wherein the handle contacts the pedestal of the front wall and the stopper is cleared from the drain hole, wherein contact between the pedestal and the handle prevents the spring from returning the shaft to the lower position; and a strainer positioned above the drain hole, wherein the strainer comprises a side surface extending in generally vertical direction, wherein an upper rim of the side surface defines an open space sized to allow the shaft and a hand to be inserted therethrough to clean out the drain hole.

16. The assembly of claim 15, further comprising:

a pivoting handle connected adjacent to the front wall of the bucket body; and a fixed back handle connected to the back wall.

17. The assembly of claim 15, further comprising a handle latch connected to the first side wall, the second side wall, or combinations thereof, wherein the handle latch extends above an upper edge of the first side wall or the second side wall, wherein the handle latch is adapted to receive and hold a wringer handle in a downward position, wherein the handle latch is movable by the wringer handle when the wringer handle is pressed against the upper portion of the latch.

* * * * *